United States Patent [19]

Hunter

[11] Patent Number: 4,842,201

[45] Date of Patent: Jun. 27, 1989

[54] ROTARY STREAM SPRINKLER UNIT

[76] Inventor: Edwin J. Hunter, 5551 Codorniz Rd., Rancho Santa Fe, Calif. 92067

[21] Appl. No.: 121,400

[22] Filed: Nov. 16, 1987

Related U.S. Application Data

[63] Continuation-in-part of Ser. No. 878,591, Jun. 26, 1986.

[51] Int. Cl.[4] ..... A62C 31/02; B05B 3/04; B05B 1/26

[52] U.S. Cl. ..... 239/396; 239/240; 239/520

[58] Field of Search ..... 239/DIG. 9, 228, 240, 239/262, 396, 500, 520, 589, 232, 246

[56] References Cited

U.S. PATENT DOCUMENTS

| | | | |
|---|---|---|---|
| 2,128,552 | 8/1938 | Rader | 239/396 |
| 2,270,595 | 1/1942 | Lewis | 239/DIG. 1 X |
| 2,569,992 | 10/1951 | Hopwood | 239/520 X |
| 4,471,908 | 9/1984 | Hunter | 239/11 |
| 4,501,391 | 2/1985 | Hunter | 239/97 |

*Primary Examiner*—Andres Kashnikow
*Assistant Examiner*—Patrick N. Burkhart
*Attorney, Agent, or Firm*—Baker, Maxham, Jester & Meador

[57] ABSTRACT

A rotary stream sprinkler unit comprises a body having a water flow passage in which is disposed a flow control unit having one or more arcuate passages configured to control the volume and pressure of a primary stream delivered to a rotary distributor head rotatably mounted at the outlet of the housing for dividing each primary stream into a plurality of final streams and rotating each of the final streams through a selected arc during the rotation of the rotary head.

10 Claims, 3 Drawing Sheets

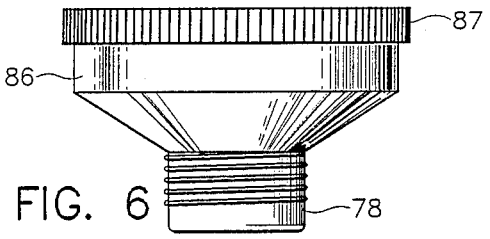
FIG. 6
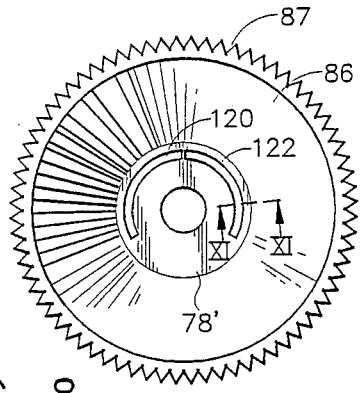
FIG. 8
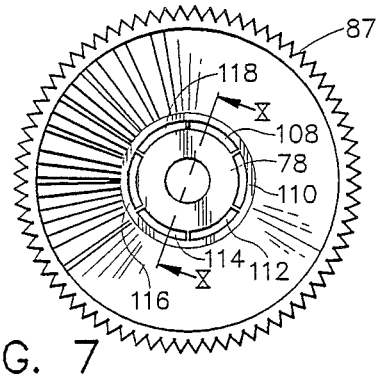
FIG. 7
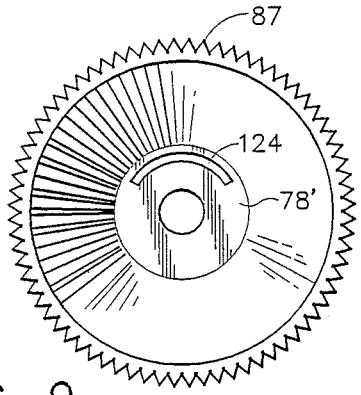
FIG. 9
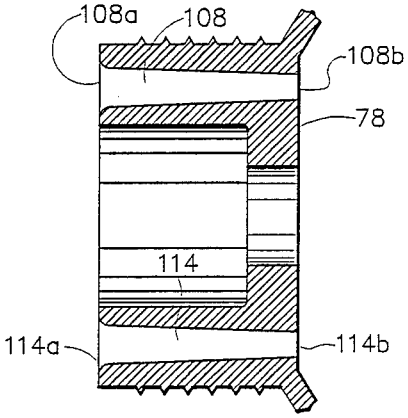
FIG. 10
FIG. 12
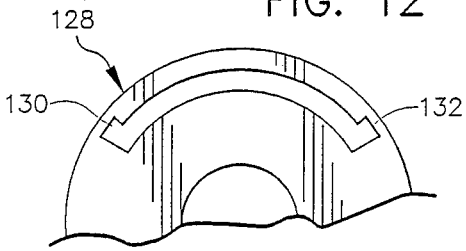
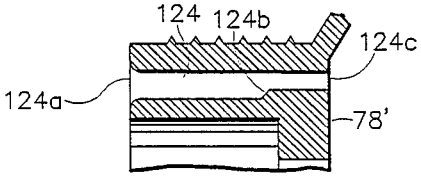
FIG. 11
FIG. 13
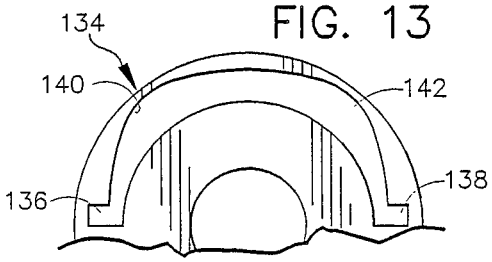

ROTARY STREAM SPRINKLER UNIT

REFERENCE TO RELATED APPLICATION

This is a continuation-in-part of my co-pending application Ser. No. 878,591, filed June 26, 1986, entitled "ROTARY STREAM SPRINKLER UNIT".

BACKGROUND OF THE INVENTION

The present invention relates to sprinkler units, and pertains particularly to a rotary stream sprinkler unit.

In my prior Pat. No. 3,854,664, issued Dec. 17, 1974, and, entitled "SPRINKLER SYSTEMS", I disclose a sprinkler unit which has a rotating head that directs a plurality of rotating streams over an area to be watered. In that prior device, the streams of water are formed in nozzles in the rotating head. The rotating head has inlets to the nozzle on one end which engages and cooperates with an orifice plate for acting as a valve for controlling communication of pressurized water to the nozzles.

My U.S. Pat. No. 4,471,908 issued Sept. 18, 1984 and entitled "PATTERN SPRINKLER HEAD" discloses a similar sprinkler unit having V-shaped nozzles in a cylindrical rotating head. The nozzle inlet openings cooperate with an orifice in an orifice plate to vary the nozzle openings to the source of pressurized water. This combination delivers streams of water of variable length and volume from the nozzles in the distributor head. The orifice opening in the plate defines the spray pattern to be produced by the streams issuing from the nozzles in the rotating head.

Among the problems of the prior device is that sand and grit from the water supply gets on the orifice plate and rapidly wears the plate and seals of the unit. In some instances, the sand and grit can cause the unit to stall. These and other problems of the prior device have prevented it from being satisfactory.

In my co-pending application Ser. No. 878,591, filed June 26, 1986, entitled "ROTARY STREAM SPRINKLER UNIT", I disclose a sprinkler unit, that is an improvement of the aforementioned patent, that utilizes an open channel head for directing the streams. It also utilizes specially configured passages or nozzles to form and control each of the streams to the channels in the head. It has been found that the passages are subject to plugging due to particles of sand and the like in the water.

Accordingly, it is desirable that an improved rotary stream sprinkler unit be available.

SUMMARY AND OBJECTS OF THE INVENTION

It is therefore the primary object of the present invention to provide an improved rotary stream sprinkler unit.

In accordance with the primary aspect of the present invention, a rotary stream sprinkler unit comprises a housing, having one or more stream passages or nozzles shaped to reduce the likelihood of blockage, with means for providing a predetermined stream volume and velocity, with an open channel rotor positioned at the outlet of the flow passages for dividing the stream into a plurality of individual streams and selectively distributing the streams over a predetermined area.

BRIEF DESCRIPTION OF THE DRAWINGS

The above and other objects and advantages of the present invention will become apparent from the following description when read in conjunction with the drawings wherein:

FIG. 6 is a side elevation view of the flow control unit;

FIG. 7 is an end view of a flow control unit like FIG. 6 showing a full circle flow passage;

FIGS. 8 and 9 are views like FIG. 7 showing alternate part circle passages;

FIGS. 10 and 11 are similar section views showing different passage configurations; and FIGS. 12 and 13 are similar enlarged end views similar to FIG. 7 showing alternate passage outlet configurations.

DETAILED DESCRIPTION OF A PREFERRED EMBODIMENT

Figure 1:
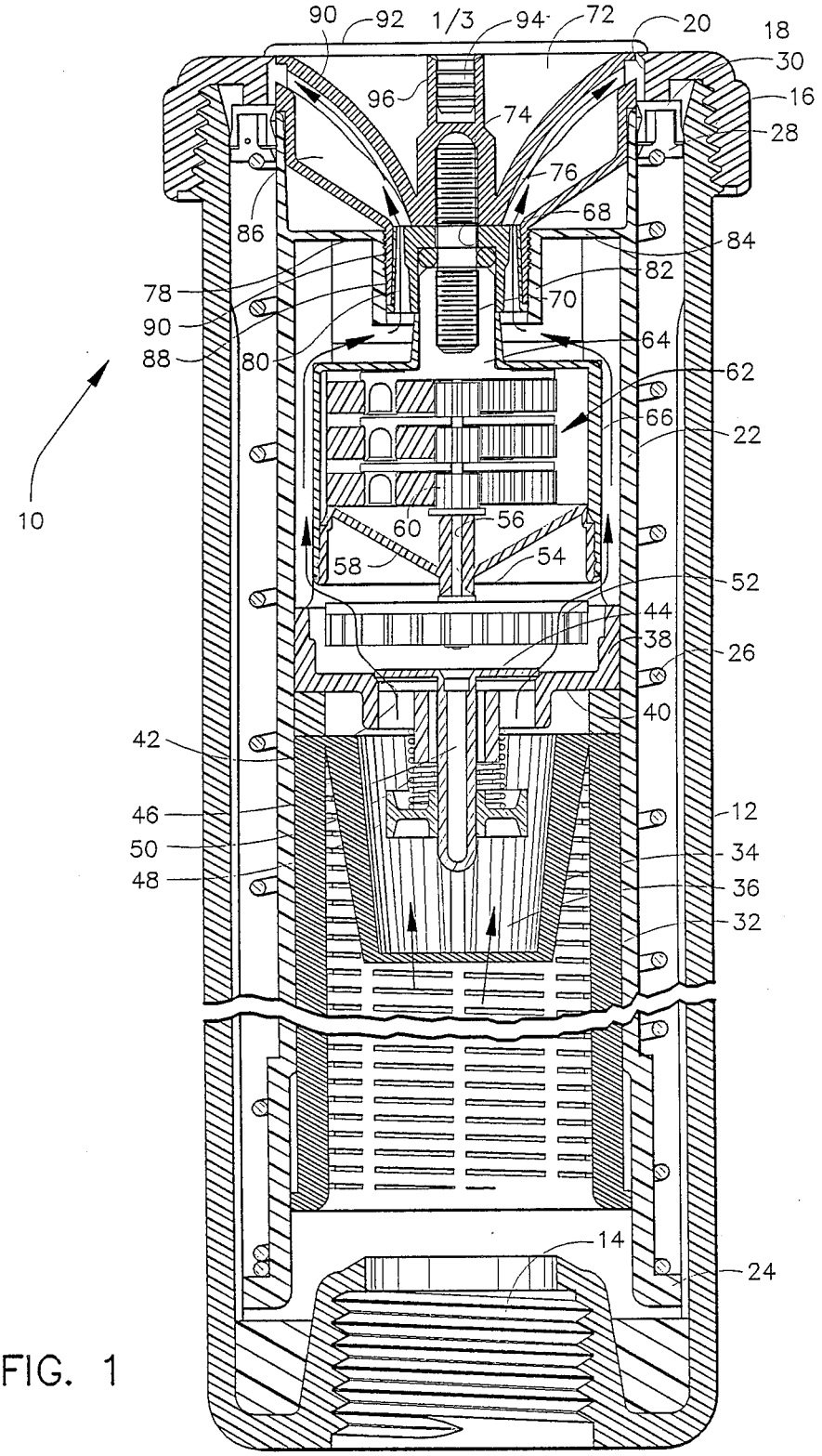
FIG. 1 is a side elevation view in section of a sprinkler unit in accordance with the invention.

Referring to FIG. 1 of the drawings, there is illustrated a sprinkler unit constructed in accordance with a preferred embodiment of the invention. The sprinkler unit, designated generally by the numeral 10, comprises an elongated generally cylindrical tubular housing 12, having a threaded inlet port 14 at one axial end, which shall be termed the lower end attachable to a suitable source of water under pressure, such as a riser.

The opposite or upper end of the housing is open and is considered the outlet end thereof. The outlet end is provided with annular threads 16 for receiving a retainer head 18, as will be explained. The head 18 has a central bore 20 for accommodating the telescopic extension of an inner tubular housing 22, which is telescopically and reciprocably mounted within the housing 12 for extension to an operative position and retraction to a non-operative position, as illustrated in FIG. 1.

The inner housing 22 includes a radially extending flange 24 at the lower end thereof, which extends outward and engages the interior surface of the wall of the outer housing 12, and also serves as a retainer for a retracting spring 26, which biases at its lower end against the flange 24 and its upper end against an annular ring 28. The ring 28 seats against a cup-shaped annular seal 30, which engages the outer surface of the inner housing 22.

The driving and flow control structure for the sprinkler unit is mounted within the inner housing 22 and carried therewith as the housing is extended upward into the operative position. Mounted within the lower end of the inner housing 12, within the tubular central bore thereof, is a screen 32 having a backward extending screen extension 34, forming a passageway 36 to a one-way valve unit for controlling the flow of water through the sprinkler unit.

A stator comprises a removable wall member, defined by a tubular extension 38, having an inwardly directed wall 40 and an opening 42 defining a valve seat, in which is seated a by-pass valve member. The by-pass valve comprises a disc 44 which engages seat 42. The valve member includes an elongated stem 46, on which is mounted a retaining head or disc 48 for retaining a coiled compression spring 50. The spring is mounted and pre-loaded for biasing the valve member 44 to its normally closed position.

Disposed upwardly or above the valve member is a turbine drive unit comprising a turbine blade 52 mounted on a rotating shaft 54, which is rotatably mounted within a bore 56 of a housing member 58. A pinion gear 60 on the upper end of the shaft 54 drives a planetary gear unit 62 sealingly mounted within a housing 66, having an output shaft or extension 64 of the gear unit journaled in and extending from the housing 66 by way of a suitable journal.

The by-pass valve acts to maintain a constant pressure drop across the turbine unit, regardless of the amount of water flowing through the sprinkler unit. This constant pressure drop determines the velocity of water flowing through one or more jets (not shown) that drive the turbine 52. This maintains a relative constant rate of rotation of the sprinkler head, regardless of water supply pressure variations.

The driven shaft 64 is drivingly connected by a threaded shaft 68 threadably connected by its lower end into a threaded bore 70 in shaft 64. The shaft 68 extends upward and is connected at the upper end of the threaded shaft 68 to a distributing head 72 by means of a threaded bore 74.

The shaft 68 extends through a bore 76 in a flow control unit 78 having a plurality of flow control passages or nozzles 80 therein. The flow control unit 78 is integral with a retaining head 86 mounted in a tubular extension 82 of an inner wall 84 of the inner housing 22. The retaining head 86 threadably engages the cylindrical extension 82 at a threaded portion 90.

The flow control unit 78, which will be further explained hereinafter, delivers one or more thin wide somewhat arcuate shaped primary streams of water to the distributing head 72. The distributing head 72 forms and directs the streams of water by way of a plurality of flow channels radially outward from the sprinkler unit and rotates the streams through an arc. The flow control unit is provided with one or more arcuate shaped passages or nozzles that have a greater width than height in order to accommodate certain foreign particles, such as flakes without plugging. A head 92 includes an extension 94 extending into a bore 96 in the head unit 72 for mounting the cover 92 thereon.

Figure 2:
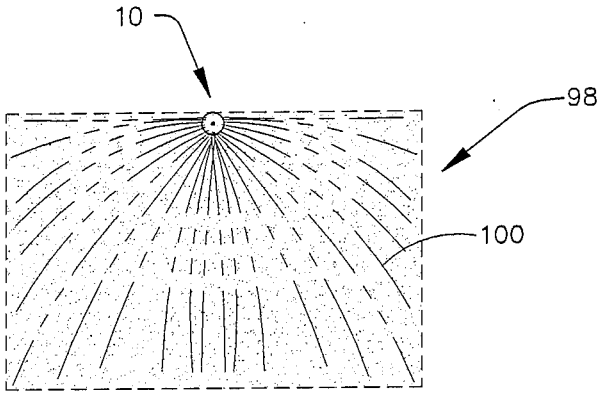
FIG. 2 is a top plan view showing an example of an area covered by the sprinkler unit.

The present sprinkler unit, as described above, is designed to distribute streams of water throughout a selected area. For example, referring to FIG. 2, the sprinkler unit has the capability, with the appropriate flow passage and nozzle configuration, of distributing streams of water over an area having a substantially rectangular shape, as illustrated in FIG. 2. The sprinkler unit may be positioned in the center of the area covered or to one side thereof. The unit accomplishes this by means of the flow control passages which controls the volume and velocity of each primary flow stream, such that the final streams have a particular reach. The distributing head has the capability of forming a plurality of final streams and directing or sweeping each stream across a particular arc or are of the plot.

For example, as shown in FIG. 2, a plot or area 98 includes a plurality of individual streams having different lengths directed outward at a particular angle from the sprinkler unit 10 and covering a particular arc of the plot 98, as will be explained with reference to the distributing head.

Figure 3:
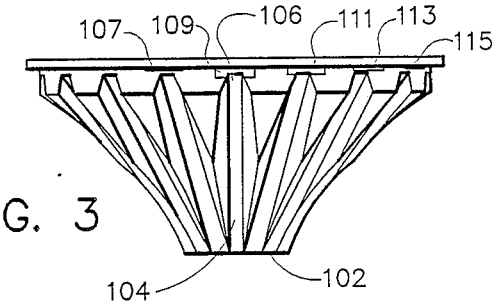
FIG. 3 is a side elevation view of the distributing head.
Figure 5:
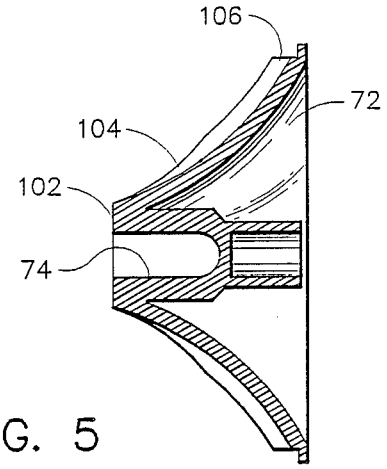
FIG. 5 is a section view of the distributing head.
Figure 4:
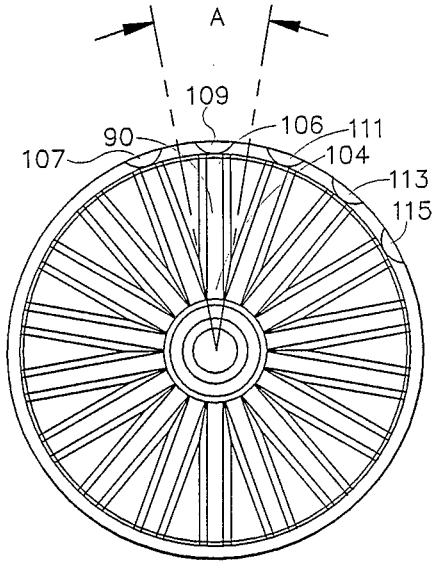
FIG. 4 is an axial view from below of the distributing head of FIG. 3.

An appreciation for the operation of the distributor head will be obtained from a view of FIGS. 3–5 and the following explanation herein. As shown in FIGS. 3–5, the distributor head has a generally curved (concave) conical configuration with a small diameter lower or inner end 102, and a larger diameter outer or top end 104, with a plurality of open water channels 90 extending therebetween. The outer surface of the head in which the channels 90 are formed is slightly curved in extending from a substantially axial direction at the apex or inlet end to a direction on the order of about fifty-five degrees thereto at the base or outlet end. The water channel 90 includes an inlet end 104 and an outlet end 106 with sloped side walls extending, as can be seen from FIG. 5, from a minimum depth at the inlet end 102 to a maximum depth at about one-third to about one-half the length thereof up to the outlet 106. The arc or curvature of the channels outward from the axis aids in confining the water to the channels and forcing it into a stream in the channel. The channels each curve outward in a common plane with the axis of the distributor head.

The distributor head, as can be seen in FIG. 1, sits directly over and is spaced from the flow control unit 78, and the inner or lower ends of the channels 102 are disposed directly over the outlet of the flow passages 90. The non-engagement of the distributor head with the flow control unit eliminates the problem of high wear and binding.

As will be appreciated from FIGS. 1, 3, 4 and 5, an outlet of a stream passage 80 is directed into the inner end of several of the flow channels 90, which are formed in and rotate with the rotary head. The rotation of the head directs the outer end of the flow stream in each channel along an arc, as will be appreciated from FIGS. 2 and 4. A portion of a flow stream that is directed into the inner end 104 of the flow channel 90 will continue to flow into that channel with a rotation of the head along an arc A, as shown in FIG. 4. As the head continues to rotate, the channel will pick up different portions of the primary flow stream, which may alter the reach of the final stream from the outer end of the channel as will be explained. The thicker portions of the stream provide higher volume of water and somewhat higher velocity of that water stream to the distributor head. The reach of the stream is thus extended.

The length of the arc at the outer end of a final stream will be determined by the radius from the center axis of the rotor to the position of striking of the stream at its outer end, and the arc of communication between the nozzle and the channel. For example, a stream may extend outward anywhere from ten to thirty feet. Thus, as the distributing head is rotating, it maintains communication with a particular flow passage for a certain degree of rotation thereof. As long as the inner end of the flow channel is in communication with a particular flow passage, water from that flow passage will be directed along the flow channel 90, along an arc determined by the angle of rotation during that communication.

As the distributing head rotates, a particular channel will in sequence pick up and distribute a portion of the flow from a flow passage or the flow passages disposed around the flow control unit in sequence in the direction of rotation of the distributing head. Thus, each primary flow stream will be in sequence picked up by a series of the flow channels as they register with that stream, and will distribute or direct the communicated portion of it along an arc as the head rotates. The length of a final stream and its coverage of the surface area will be determined by the velocity and other characteristics of the stream. The majority of the water will be deposited at or near the outer perimeter of the sprinkler units coverage unless the streams are altered.

The distributing head 72 may also be provided with pads or the like 109–115, as illustrated in FIG. 5, which extend into the stream for further altering of the final streams. The pads extend into tee stream different amounts to break up the stream and further alter the pattern of distribution. The touching of the stream by a pad imposes a drag on the stream which shortens its reach, and also breaks portions of the stream away into droplets which strike the ground between the sprinkler unit and its outer reach. This more evenly distributes the water over an area of coverage of a sprinkler unit.

Referring now to FIGS. 6–12, the construction and operation of the flow control unit will be further explained. For purposes of this discussion, the flow passage will be considered to have a length extending along a longitudinal axis parallel to the central axis of the housing. The passage will have a height measured radially outward from the central axis and a width measured around the central axis. As shown in FIGS. 6–12 for illustrative purposes, several different flow modifying or control passages are illustrated that will explain the principles of the invention. The outlet end of the flow control units are illustrated in FIGS. 7–9, 12 and 13, showing the outlets to be one or more substantially arcuate (or part circular) passages.

Referring to FIG. 6, this flow control unit is embodied in a generally funnel shaped member having a lower cylindrical portion forming the flow control unit, and an upper bowl portion 86 which also serves as a head for the inner tubular housing 22. The bowl 86 has an upper serrated rim portion 87 for facilitating gripping with the fingers for threadably inserting and removing it from a housing.

The outlet end of the unit 78 is shown in FIG. 7, with the outlet of the nozzles or passages being shown in the form of a plurality of arc shaped passages 108 through 118 to provide full 360 degree coverage. The cross-section of the passages may be further altered or varied to provide selective areas of coverage, as will be further explained. In viewing the passages along the axis of the member 78, as viewed in FIG. 7, it is seen that the passages have a width (arc length) that is several times the height (radial dimension) thereof. These slot shaped passages more easily accommodate particles, such as grains of sand and flakes without plugging.

Referring to FIG. 7, a flow control unit 78' is illustrated as having a pair of arcuate passages 120 and 122 to provide 180 degrees of coverage about the axis thereof. These passages may also be varied in height at selected positions, as will be described, to provide selected areas of coverage.

A quarter circle arc 124 is illustrated in a unit 78'' in FIG. 9, which provides a quarter circle coverage. The cross-section of the passage may be varied, as will be explained, to alter the pattern and area of coverage by altering the volume and velocity of water through that portion of the passage. These passages as described above provide full circle, half circle, and quarter circle coverage, respectively.

As will be further explained with reference to FIGS. 10 and 11, the longitudinal cross-sectional configuration of the passage helps determine the volume and velocity of the stream. The distance achieved by a stream is a product of the volume and velocity of the water as it strikes the rotating distributor head. In my prior applications, the flow control passages had a circular cross-sectional configuration. A problem with those passages is that they can be easily clogged by certain foreign particles, particularly flakes in the water.

The flow control passages of the present invention have an elongated substantially arc cross-section with a width that is several times the average height of the passage. Each of these passages substitutes for a plurality of the passages of the prior construction. The present passages are able to more easily accommodate a wide variety of foreign particles in the water without plugging. In particular, the present passages are constructed to more easily accommodate flakes and flake-like particles in the water.

Referring to FIGS. 10 and 11, it is seen that the passages may differ in longitudinal cross-section along their lengths between the inlet and the outlet. The passages may also be constructed to have variations in the lateral cross-sectional configuration as illustrated in FIGS. 12 and 13. These various differences in the passages help determine the size and velocity of the stream, which determines the reach or distance that the stream will have for a given pressure head. Thus, with proper selection of the passage parameters, various distribution patterns can be achieved.

Referring again to FIG. 6, it will be seen that the flow control unit 78 is provided with a full circle of passages 108, 110, 112, 114, 116 and 118 with the same arc length, but may or may not have different cross-sectional configurations. More particularly, it will be appreciated that the unit 78 is symmetrical about its center axis, with directly opposite bores or passages that may be formed identically or differently to achieve the desired pattern. The unit 78 may be configured to give a somewhat rectangular pattern, with the sprinkler unit 10 located in the center of the plot. It can also be easily configured to provide a rectangular plot, such as in FIG. 2, by plugging all passages on one side of the unit 78, or forming with a shorter (180 degree) arc of passages (as in FIGS. 8), or further modified as in FIGS. 12 and 13. Thus, various areas can be covered around the sprinkler unit by the arc of coverage as seen in FIGS. 7–9, and by the shape of the passage as in FIGS. 12 and 13.

Referring alternately between FIGS. 7 and 10, sets of passages are shown A section through 108 and 114 of FIG. 7 is illustrated with passages 108 and 114 having a configuration as shown in FIG. 10. The passages are shown with a streamlined inlet section **108*a* and 114*a*, with a gradually reduced height to a slightly smaller cross-section at the outlet 108*b* and 114*b***. This gradually reduced outlet section increases the flow rate of a stream and its reach. This configuration provides the most efficient stream of water and the maximum velocity to provide the greatest reach for a given length passage, size stream and pressure head.

Referring to FIG. 11, an arrangement is illustrated wherein a passage 124 has a streamlined inlet, with a restricted portion beginning at **124*b* and extending up to the outlet 124*c*. This restricted and shorter passage results in an increase in pressure and velocity in the flow as it enters the outlet section at 124*b*, and provides a longer reach than a passage like 108** of the same cross-section at the outlet. The inlet and other portions of this passage can also be modified in other ways, some of which will be discussed, to provide a still different reach.

Alternate constructions (not shown) can be made wherein a passage has a streamlined inlet with a uniform cross-section extending throughout its length to an outlet. This passage provides a slightly shorter reach than a passage like 108, for example, with a gradual reduction. Eliminating the streamlined inlet portion and making the inlet with a sharp edge or corner would shorten the reach still further.

A still further modification can be made in the passage to alter the distribution wherein lateral cross-sectional modifications are made in the passages. Referring to FIG. 12, a quarter circle passage 128 is provided with enlarged portions 130 and 132 at the ends thereof. These enlarged portions provide a greater flow at these positions than would be available from a standard height slot. Without this enlarged portion, the reach of the flow at the end of the sides of the slot or passage would be less than that in the mid area of the slot. This is because anything that touches the stream will induce drag on it and slow its velocity and ultimate reach.

Referring to FIG. 13, a half circle passage 134 is illustrated which is configured to provide a rectangular plot coverage with the unit located on one side of the plot. The passage 134 varies in height along its width to provide a constantly changing throw or reach for the final streams. The passage provides selected areas of increased flow along the width thereof. The ends of the passage 134 at 136 and 138 are increased in height to provide a reach almost equal to the reach from the adjacent area of the passage. The passage gradually increases in height from the area adjacent to 136 up to its maximum height at 140, which would provide flow to the corner of the plot. The height then decreases to a position between 140 and 142 where it begins to increase again up to 142 for the other far corner of the plot. The height again decreases from 142 to a position adjacent 138 where it increases again.

The size, shape and number of the passages in the flow control unit can be modified to provide just about any desired area of coverage. For example, any number of different configuration passages may be provided in a particular flow unit. Similarly, any number of the passages can be modified to provide flow through only certain of the passages. This provides a number of modifications for obtaining a selected different area of coverage of the unit.

In operation a sprinkler unit is selected having the proper flow control unit to cover the desired area. The flow control unit is selected to have the proper flow passage and orifice cross-section for supplying the primary flow stream with the appropriate cross-section or thickness of stream at the proper positions around the orifice to provide the necessary flow to the rotor. The rotor picks up a portion of the primary stream, with each channel which forms and directs a plurality of final streams outward in proportion to the water supplied thereto. The amount of water supplied to a particular channel at any one time depends on the cross-section of the orifice at that position. A channel will pick up an amount of water equal to its width and the height of the passage or orifice at the channel position. Therefore, the amount of water feeding or forming the final stream will increase or decrease as the passage changes in thickness.

While I have illustrated and described my invention by means of a specific embodiment, it is to be understood that numerous changes and modifications may be made therein without departing from the spirit and scope of the invention as defined in the appended claims.

I claim:

1. A rotating stream sprinkler unit comprising:

a tubular housing having a central axis, an inlet, an outlet, and a flow passage communicating therebetween for conducting a stream of water from said inlet to said outlet;

means for forming said stream of water into at least one substantially thin wide primary stream parallel to said axis at said outlet;

said means for forming said stream of water comprises a body member mounted in said channel;

at least one substantially arcuate flow passage in said body member disposed in a circular arc and extending along said body member parallel to said central axis toward the outlet;

said passage is shaped at the outlet thereof for providing a substantially rectangular distribution pattern;

said passage further covers a generally 180 degree arc and is shaped to have portions at the sides thereof being larger than the adjacent portions of said passage;

a rotating distributor head having a plurality of flow channels therein rotatably mounted at said outlet for receiving and forming said primary stream into a plurality of final streams and continuously directing said plurality of streams over a predetermined area.

2. A sprinkler unit according to claim 1 wherein:

said passage covers a generally 180 degree arc and is shaped to have portions at the sides thereof and at two positions intermediate thereof, said portions being larger than the adjacent portions of said passage.

3. A sprinkler unit according to claim 1 wherein: said passage has variations in cross-section from one side to the other.

4. A sprinkler unit according to claim 1 wherein: said body member comprises a plurality of said passages that differ in configuration for generating different velocity streams.

5. A sprinkler unit according to claim 4 wherein: at least one of said passages has a uniform cross-section throughout the length thereof.

6. A sprinkler unit according of claim 4 wherein:

at least one of said passages has a stepped decrease in cross-section from the inlet to the outlet thereof.

7. A sprinkler unit according to claim 4 wherein:

at least one of said passages has a progressively decreasing cross-section from the inlet to the outlet thereof.

8. A sprinkler unit according to claim 1 wherein:

said flow channels on said distributor head are open channels.

9. A sprinkler unit according to claim 1 wherein:

said restricted passage has a uniform cross-section throughout the length thereof.

10. A sprinkler unit according of claim 1 wherein:

said restricted passage varies in cross-section between the ends thereof.

* * * * *